US010464350B2

(12) United States Patent
Kearns

(10) Patent No.: US 10,464,350 B2
(45) **Date of Patent: *Nov. 5, 2019**

(54) PRINTING PRINT FRAMES BASED ON MEASURED FRAME LENGTHS

(71) Applicant: HEWLETT-PACKARD DEVELOPMENT COMPANY, L.P., Houston, TX (US)

(72) Inventor: James Kearns, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/876,485

(22) Filed: Jan. 22, 2018

(65) Prior Publication Data

US 2018/0141353 A1 May 24, 2018

Related U.S. Application Data

(63) Continuation of application No. 14/899,204, filed as application No. PCT/US2013/048475 on Jun. 28, 2013, now Pat. No. 9,895,910.

(51) Int. Cl.

| | |
|---|---|
| ***B41J 13/00*** | (2006.01) |
| ***B41J 11/42*** | (2006.01) |
| ***B41J 15/04*** | (2006.01) |

(52) U.S. Cl.

CPC ..... *B41J 13/0009* (2013.01); *B41J 11/425* (2013.01); *B41J 15/04* (2013.01)

(58) Field of Classification Search

CPC ..... B41J 13/0009
USPC ..... 400/76
See application file for complete search history.

(56) References Cited

U.S. PATENT DOCUMENTS

| | | | | |
|---|---|---|---|---|
| 4,485,982 | A | 12/1984 | St. John et al. | |
| 5,289,770 | A | 3/1994 | Hern | |
| 5,572,433 | A * | 11/1996 | Falconer | B65H 23/046 226/2 |
| 5,795,280 | A | 8/1998 | Fowler et al. | |
| 6,295,424 | B1 * | 9/2001 | Regelsberger | G03G 15/1675 399/160 |
| 6,382,850 | B1 | 5/2002 | Freund | |

(Continued)

FOREIGN PATENT DOCUMENTS

| | | |
|---|---|---|
| CN | 1986218 A | 6/2007 |
| EP | 2179852 A1 | 4/2010 |
| WO | WO-2008134089 | 11/2008 |

OTHER PUBLICATIONS

Choi, K. et al.; Web Tension Control of Multispan Roll to Roll System by Artificial Neural Networks for Printed Electronics; Sage Journals; Jan. 9, 2013; http://pic.sagepub.com/content/early/2013/01/08/0954406212473041.abstract.

*Primary Examiner* — Anthony H Nguyen
(74) *Attorney, Agent, or Firm* — Fabian VanCott

(57) ABSTRACT

In an example implementation, a processor-readable medium stores code representing instructions that when executed by a processor cause the processor to initiate motion of a media web in an inkjet web press, begin printing a print frame based on a start pulse from a metering device, verify that printing the print frame is complete, receive a signal from the metering device that a frame-length of the media web has been measured at the output of the press, and begin printing a new print frame based on the verification and the signal.

20 Claims, 5 Drawing Sheets

(56) References Cited

U.S. PATENT DOCUMENTS 7,584,699 B2 9/2009 Ford
8,328,315 B2 12/2012 Eun
8,376,516 B2 2/2013 Viturro et al.
8,408,827 B2 * 4/2013 Takeuchi ..... B41J 11/008 347/14
8,668,318 B2 * 3/2014 Chappell ..... B41J 11/002 347/103
8,753,026 B2 6/2014 Haan
2002/0001006 A1 * 1/2002 Matsumoto ..... B41J 11/008 347/16
2002/0048478 A1 4/2002 Klinefelter
2004/0028448 A1 2/2004 Seiler et al.
2005/0206715 A1 * 9/2005 Sasaki ..... B41J 11/0075 347/221
2005/0248798 A1 * 11/2005 Hughes ..... G03G 15/5041 358/1.13
2006/0284965 A1 * 12/2006 Tsubota ..... B41J 11/008 347/217
2007/0144373 A1 6/2007 Okura et al.
2009/0136279 A1 * 5/2009 Kawabata ..... G03G 15/234 399/401
2010/0266324 A1 10/2010 Shibuya
2010/0330262 A1 12/2010 Takeuchi
2011/0252992 A1 * 10/2011 Viturro ..... B41J 11/42 101/484
2011/0255911 A1 10/2011 Eun et al.
2012/0042760 A1 2/2012 Mitsuhashi
2012/0148326 A1 6/2012 Ipponyari
2012/0257917 A1 10/2012 Bockus, Jr.
2013/0019723 A1 1/2013 Nadrchal et al.
2013/0038669 A1 * 2/2013 Mizutani ..... B41J 3/4075 347/104
2013/0114987 A1 5/2013 Helterline et al.
2013/0304422 A1 * 11/2013 Ausserlechner ..... G01R 33/07 702/189

* cited by examiner

PRINTING PRINT FRAMES BASED ON MEASURED FRAME LENGTHS

BACKGROUND

An inkjet web press is a high-speed, digital, industrial inkjet printing solution that prints on a continuous media web at speeds of hundreds of feet per minute. A roll of media (e.g., paper) on an unwinding device supplies the press with a paper web which is conveyed through the press along a media path. Stationary inkjet printheads along the media path eject ink droplets onto the web to form images. The paper web is then conveyed through a drying area and out of the press through rollers to be rewound on a rewinding device.

Aqueous inks used in inkjet printing contain a significant amount of water that can saturate the media. In an inkjet web press, this causes the media to expand, lengthening the web. However, when the media is dried, it often shrinks back down to a level below its initial state. Therefore, the amount of media (e.g., paper) coming out of the press is often less than the amount of media being fed into the press. Among other things, this media distortion can complicate post-print finishing operations performed on the printed material by certain finishing devices.

BRIEF DESCRIPTION OF THE DRAWINGS

The present embodiments will now be described, by way of example, with reference to the accompanying drawings, in which.

Throughout the drawings, identical reference numbers designate similar, but not necessarily identical, elements.

DETAILED DESCRIPTION

Overview

Figure 1:
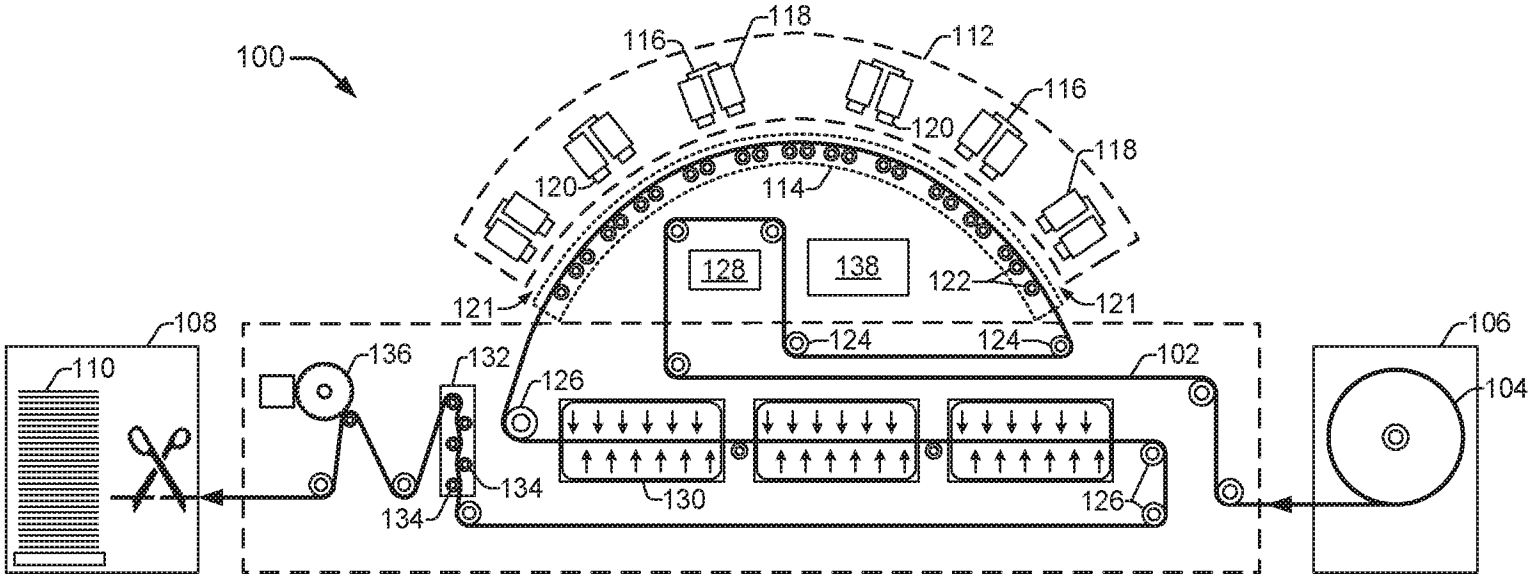
FIG. 1 shows a schematic illustration of a printing system suitable for providing fixed frame-length control of print frames on a media web, according to an example implementation.

As noted above, the printing process in an inkjet web press causes distortion in the media web that complicates post-finishing operations in certain finishing devices. More specifically, the significant application of moisture to the web during printing, followed by the removal of that moisture through a drying process, typically results in a variability in print frame length and an overall reduction in the length of the web. For example, the media web can shrink at a rate of approximately 0.2%, which is about 1 foot for every 500 feet of web fed into the press.

Finishing devices that initiate finishing operations on a fixed index basis for each print frame printed on the web, or multi-web finishing devices that combine rolls from different sources, do not tolerate such media shrinkage effectively. This is because the shrinking media web eventually causes print frames to drift out of the device's tolerance band, and the finishing operations (e.g., paper cuts) begin to occur within adjacent print frames rather than between print frames as intended. Fixed index finishing devices are, however, generally capable of staying within tolerances when used in conjunction with analog printing processes. This is because inks used in analog printing processes are formulated with much less water than the inks used in a digital inkjet web press. Therefore, analog printing involves less wetting and drying of the media, which results in less media distortion.

In order to accommodate the higher rate of media shrinkage associated with a digital inkjet web press, a finishing device would have to initiate finishing operations based on triggers from the media or the press. Advanced digital finishing devices are available that provide such triggering mechanisms based on control systems that compensate for the cumulative error in web length. However, many commercial (and other) print customers who operate digital inkjet web presses prefer the lower costs and higher productivity of fixed index finishing equipment. Moreover, many print customers who already own such legacy finishing equipment want to leverage it forward rather than incur the significant costs associated with acquiring more advanced digital finishing devices.

Embodiments of the present disclosure provide for fixed frame-length control in an inkjet web press which enables the complementary use of fixed index finishing equipment with the press and compatibility with multi-web finishing processes. In general, fixed frame-length control is achieved through a metering device that meters the media web after it has undergone distortions associated with the printing and drying process within the inkjet web press. A metering mechanism and metering algorithm function together to ensure that the printing on the web of each new print frame within the print zone is triggered based on at least two events. One event is the metering of a given distance of media at the output of the press, and the other event is a verification by the print controller that all the print instructions for the current print frame have been executed, which confirms that the current print frame has finished printing. Although printing in the print zone is clocked or metered by encoding the media or media drive system, the printed image itself still shrinks during the drying process. However, the start of each print frame within the print zone is initiated based on a measurement of the media as it exits the press at its final dimension (i.e., after the media has finished shrinking). This helps ensure that each print frame printed on the web will be on a consistent pitch. A finishing device that initiates actions (e.g., paper cutting) on a fixed index can then process the web and stay within its tolerance band.

In an example implementation, a processor-readable medium stores code representing instructions that when executed by a processor cause the processor to initiate motion of a media web in an inkjet web press, begin printing a print frame based on a start pulse from a metering device, verify that printing the print frame is complete, receive a signal from the metering device that a fixed frame-length of the media web has been measured at the output of the press, and begin printing a new print frame based on the verification and the signal.

In another example implementation, a processor-readable medium stores code representing instructions that when executed by a processor cause the processor to measure a media web as it is output from an inkjet web press, determine if a current print frame has completed printing in a print zone of the inkjet web press, and initiate printing a new print frame in the print zone when a fixed frame-length of the media web has been measured out of the inkjet web press, and when the current print frame is verified to be completed printing.

In another example implementation, an inkjet web press includes a metering device to measure dry, printed-upon media output from an inkjet web press. The press also includes a controller to start printing a new print frame when two criteria are met. The two criteria comprise, receiving a signal from the metering device that a fixed frame-length of the dry printed-upon media has been measured, and verifying that a current print frame has completed printing.

Illustrative Embodiments

FIG. 1 shows a schematic illustration of a printing system 100 suitable for providing fixed frame-length control of print frames on a media web, according to an example implementation. The printing system 100 is shown in FIG. 1 and will be described herein, as an inkjet web press 100. However, there is no intent to limit the printing system 100 to the implementation shown and described with regard to FIG. 1. Rather, various concepts disclosed herein, including those regarding fixed frame-length control, are applicable to other configurations and types of printing systems 100 as appropriate.

An inkjet web press 100 is generally configured to print ink or other fluid onto a web of media 102 supplied by a media roll 104 from an unwinding device 106, also shown in FIG. 1. The web of media 102 (variously referred to herein as media web 102, web 102, media 102, etc.) comprises printing material such as cellulose-based material (i.e., paper) or polymeric material, for example. In the present implementation, the media web 102 is considered to be a cellulose-based paper material that exhibits expansion when moisture is applied and contraction when the moisture is removed. The width of the media web 102 can vary, but is on the order of 20-40 inches.

As the media web 102 exits the inkjet web press 100, it may be rewound on a rewinding device and subsequently transferred to a near-line finishing device, or it may pass directly to a post-print, in-line finishing device 108, as shown in FIG. 1. Finishing devices 108 perform finishing operations on printed material after printing has been completed. Such operations include, for example, paper slitting, cutting, trimming, die-cutting, folding, coating, embossing, and binding. While finishing operations can be performed by one or more finishing devices that are in-line or near-line with the press 100, the present implementation is discussed with regard to a single in-line web cutting finishing device 108, as shown in FIG. 1. The finishing device 108 comprises a fixed index web cutting device, such as a cutoff knife on a rotary drum, that cuts the media web 102 at fixed intervals. Cut media from the web 102 is shown as a media stack 110, which may be collected within finishing device 108 or within a separate media stacking device (not shown).

Inkjet web press 100 includes a print module 112 and media support 114. Print module 112 includes a number of print bars 116, and one or more pens or cartridges 118 that each include a number of fluid drop jetting printheads 120. Printheads 120 eject drops of ink or other fluid through a plurality of orifices or nozzles (not shown) toward the media web 102 so as to print onto the web 102. Thus, a print zone 121 is established between the print module 112 and media support 114. Nozzles are typically arranged on printheads 120 in one or more columns or arrays so that properly sequenced ejection of ink causes characters, symbols, and/or other graphics or images to be printed on media web 102 as it moves relative to print bars 116 along media support 114.

Media support 114 comprises a number or media rollers 122 that support the media web 102 as it passes through the print zone 121 in close proximity to the print bars 116. Media support 114 receives the web 102 from media drive rollers 124 and delivers the printed upon web 102 to media rewind rollers 126. Drive rollers 124 are generally referred to herein as rollers that precede the media support 114 along the media web path, while rewind rollers 126 are referred to as rollers that follow the media support 114 along the media web path. The drive 124 and rewind 126 rollers are control rollers driven by a web drive 128.

As the media web 102 passes through the print zone 121 along media support 114, it becomes wet from ink and/or other fluid ejected from printheads 120. As noted above, the wetting of the web 102 causes the media to expand, which lengthens the web. The inkjet web press 100 includes one or more thermal dryers 130 that remove the moisture from the web 102 by forcing warm air across the web as it passes over a series of rollers. The drying process typically shrinks the media back down to a level below its initial state. Thus, the wetting and drying of the web 102 effectively result in a net reduction in the length of the media web 102.

In some implementations, the media web 102 may be routed through a "chill stack" 132 after being dried by thermal dryers 130. A chill stack 132 typically comprises one or more chill rollers 134 that are used to cool the web 102. When the web 102 contacts an exterior surface of a chill roller 134, heat from the web conducts through the exterior surface to the interior of the chill roller 134. Chill rollers 134 may have an interior chilling mechanism such as chilled liquid that carries the heat away. In some printing applications, a chill stack 132 is useful to cool the web in order to help set the ink. In the present implementation, a chill stack 134 can be employed to cool the web in order to avoid a thermal expansion of a metering device 136 at the output of the press 100. Thermal expansion from heat carried in the web 102 can adversely impact the accuracy of certain types of metering devices 136. As discussed further below, the metering device 136 at the end of the press 100 measures a set amount of the media web 102 (i.e., a fixed frame length) coming out of the press. Each time the set amount of media exits the press, the metering device 136 sends a signal to a controller 138 to indicate the set amount of media has been output from the press 100.

Figure 2:
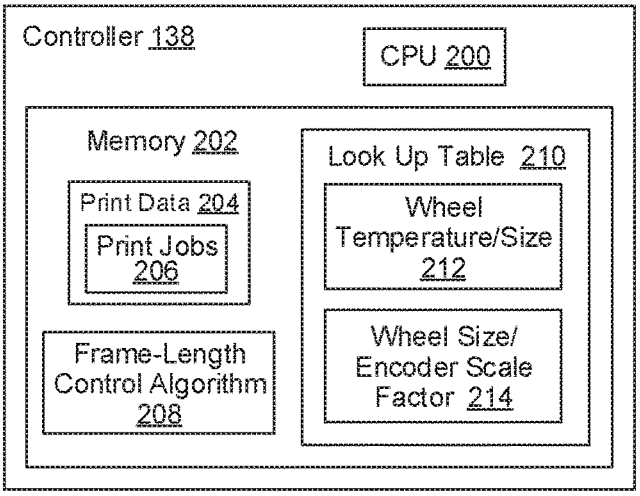
FIG. 2 shows a box diagram of an example controller suitable for controlling print functions of an inkjet web press and for providing fixed frame-length control of print frames on a media web, according to an example implementation.

FIG. 2 shows a box diagram of an example controller 138 suitable for controlling print functions of an inkjet web press 100 and for providing fixed frame-length control of print frames on a media web 102. Controller 138 generally comprises a processor (CPU) 200 and a memory 202, and may additionally include firmware and other electronics for communicating with and controlling the other components of the inkjet web press 100, as well as external devices such as unwinding device 106. Memory 202 can include both volatile (i.e., RAM) and nonvolatile (e.g., ROM, hard disk, floppy disk, CD-ROM, etc.) memory components comprising non-transitory computer/processor-readable media that provide for the storage of computer/processor-executable coded instructions, data structures, program modules, JDF, and other data.

In one example implementation, controller 138 receives data 204 from a host system, such as a computer, and temporarily stores the data 204 in memory 202. Data 204 represents, for example, a document and/or file to be printed. As such, data 204 forms a print job 206 for inkjet web press 100 that includes one or more print job commands/instructions, and/or command parameters executable by processor 200. Thus, controller 138 controls inkjet printheads 120 to eject ink drops from printhead nozzles onto media web 102 as the web 102 passes through the print zone 121. The controller 138 thereby defines a pattern of ejected ink drops that form characters, symbols, and/or other graphics or images on the media web 102. The pattern of ejected ink drops is determined by the print job commands and/or command parameters within data 204.

In one implementation, controller 138 includes a frame-length control algorithm 208 stored in memory 202. The frame-length control algorithm 208 comprises instructions executable on processor 200 to precisely control when the print module 212 begins printing each print frame of a print job 206 within the print zone 121. A print frame comprises a unit of formatted output (i.e., print job instructions) printed onto the web 102. In general, the algorithm 208 determines when to trigger the printing of each print frame based on receiving a signal from metering device 136, and a verification that all the print instructions for a current print frame have been executed. As mentioned above, a metering device 136 at the end of the press 100 measures a set amount of the media web 102 coming out of the press. Each time the set amount of media exits the press, the metering device 136 sends a signal or pulse to the controller 138 to indicate that the set amount of media has been output from the press. The length of the set amount of media being metered out of the press 100 is the length of a print frame. Controller 138 can also include a look up table 210 stored in memory 202 that includes data to enable compensating for dimensional changes that can occur in certain types of metering devices 136, as discussed in greater detail below.

In one implementation, the metering device 136 can comprise a metering wheel whose circumference is the same length as the print frame it is measuring out. When the metering wheel completes a full rotation, the metering wheel signals the controller 138 that the length of one print frame has been metered out of the press 100. While a metering wheel having a fixed circumference is a simple way to implement the metering device 136, this implementation involves changing the metering wheel to a different wheel having a different circumference each time the length of the print frame changes. Because the length of the print frame can change with each different print job, it can be advantageous to use other types of metering devices that do not involve wheel changes to accommodate for variations in print frame lengths.

In another implementation, for example, the metering device 136 can comprise an encoded roll, or encoded wheel. An encoded wheel provides greater metering flexibility, as different print frame lengths can be easily measured out of the press 100 by knowing the distance between encoding marks on the wheel. A signal is sent to the controller 138 to indicate that the length of a print frame has been output from the press 100 when the number of encoder marks metered through adds up to a distance equal to the length of the print frame.

Figure 3:
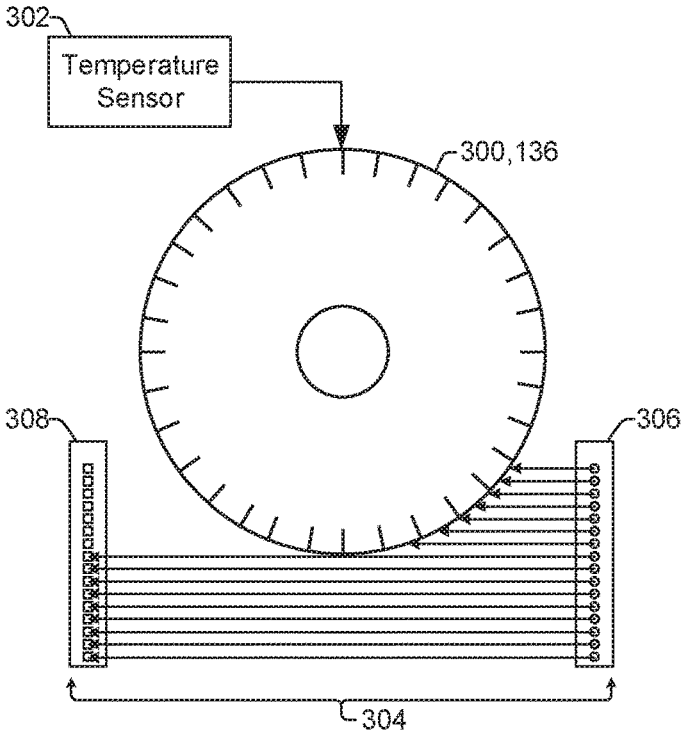
FIG. 3 shows a metering device implemented as an encoded wheel, according to an example implementation.

FIG. 3 shows an example of a metering device 136 implemented as an encoded wheel 300. As with a simple metering wheel, thermal expansion from heat carried in the web 102 can adversely impact the accuracy of the encoded wheel 300 by lengthening the distance between the encoder marks on the wheel. As noted above, a chill stack 134 that removes the heat from the web prior to encountering the metering device 136 is one method of avoiding the problem of thermal expansion, and it is applicable to both a simple metering wheel and for an encoded wheel. However, another way to account for the heat from the web is to compensate for the resulting thermal expansion by measuring the changing dimension of the encoded wheel 300, and then scaling the distance between encoder marks accordingly to measure an accurate length of the web. Measuring the dimension of the wheel 300 can be achieved in several ways, such as using optical or proximity sensors to directly measure the wheel dimension, or by measuring the temperature of the wheel 300 and using the temperature to calculate dimensional changes to the wheel.

As shown in FIG. 3, a temperature sensor 302 can be used to measure the wheel temperature. Thus, in one implementation, executing instructions from frame-length control algorithm 208, controller 138 receives temperature data from the temperature sensor 302 and uses the temperature data to look up the wheel size in look up table 210, using the wheel temperature and size correlation data 212. The controller 138 then uses the wheel dimension to find an encoder scaling factor, using the wheel size and scale factor correlation data 214 from the look up table 210. The scale factor enables the controller 138 to appropriately adjust changes in distance between encoder marks on the wheel 300 that result from the temperature expansion.

Also shown in FIG. 3, is an optical sensor 304 that measures changes in the size of the encoder wheel 300. The optical sensor 304 includes a bank of light emitters 306 and a bank of light receivers 308. Light beams 310 are transmitted from the light emitters 306 toward the light receivers 308, and the encoder wheel 300 blocks a number of the light beams 310 depending on the size of the wheel 300. As the wheel 300 grows in size due to thermal expansion, it blocks more of the light beams 310 from reaching the light receivers 308. In this way, the optical sensor 304 measures the changing size of the wheel 300. Optical sensors 304 are generally available that can measure down to one-half micron changes in the diameter of the wheel 300. Thus, in one implementation, executing instructions from frame-length control algorithm 208, controller 138 receives wheel size/dimension data from the optical sensor 304 and looks up associated encoder scaling factors, using the wheel size and scale factor correlation data 214 from the look up table 210. The scale factor enables the controller 138 to appropriately adjust changes in distance between encoder marks on the wheel 300 that result from the temperature expansion.

Figure 4:
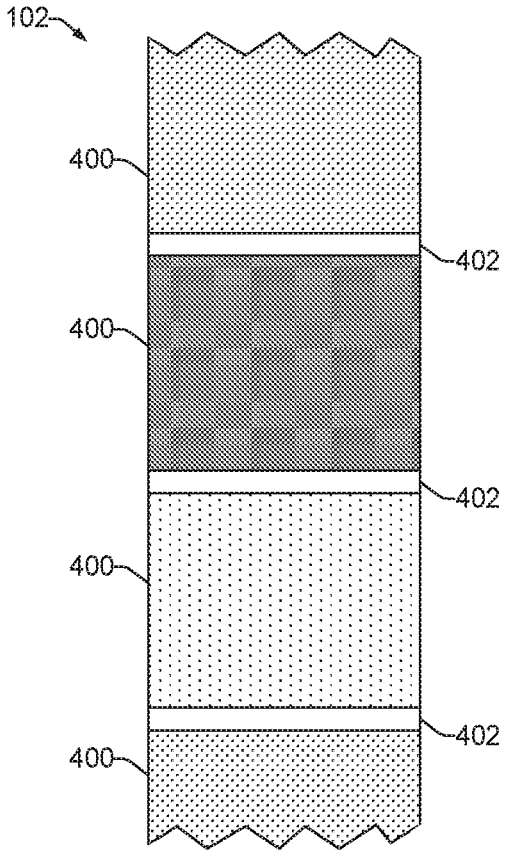
FIG. 4 shows an example of a portion of a printed media web as it might appear when being output from an inkjet web press through metering device and entering finishing device, according to an example implementation.

FIG. 4 shows an example of a portion of a printed media web 102 as it might appear when being output from the press 100 and through a metering device 136 and entering finishing device 108. Print frames 400 printed on the media web 102 generally include a tolerance band 402 between the printed frames 400 that accounts for variance in the accuracy of the finishing device 108 to place the web cut (or other finishing operation) between printed frames 400. The lengths of print frames 400 between different print jobs 206 vary widely, and are on the order of between around 7 and 72 inches. The tolerance band 402 between print frames 400 is on the order of 1-2 mm in length. To stay within tolerance, a finishing device 108 should initiate a finishing operation (e.g., a web cutoff) at fixed intervals that fall within the tolerance band 402.

Referring now to FIGS. 2 and 4, frame-length control algorithm 208 does not trigger the printing of a new frame 400 until it receives both a frame-length signal from the metering device 136 (indicating a print frame-length has been metered out of the press), and a verification from controller 138 that all the print instructions for the current frame have been executed. The verification from controller 138 confirms that the current print frame has completed printing. Using the combination of the frame-length signal from the metering device 136, and the completed frame print verification from the controller 138, the algorithm ensures that, regardless of the distortion the web 102 may experience during the printing and drying process within the press 100: 1) the length of each print frame 400 entering the fixed index finishing device 108 is on a constant pitch (i.e., the frames 400 are a constant distance apart); and, 2) the unit of formatted output making up each print frame 400 is printed within the length of each print frame 400.

Therefore, when the fixed index finishing device 108 cuts the web 102 at a fixed interval, the cuts will be properly placed within the tolerance band 402 between frames 400, the printed output for each frame 400 will be within the length of each print frame 400, and the print frames 400 will not drift out of the device's tolerance band.

Figure 5:
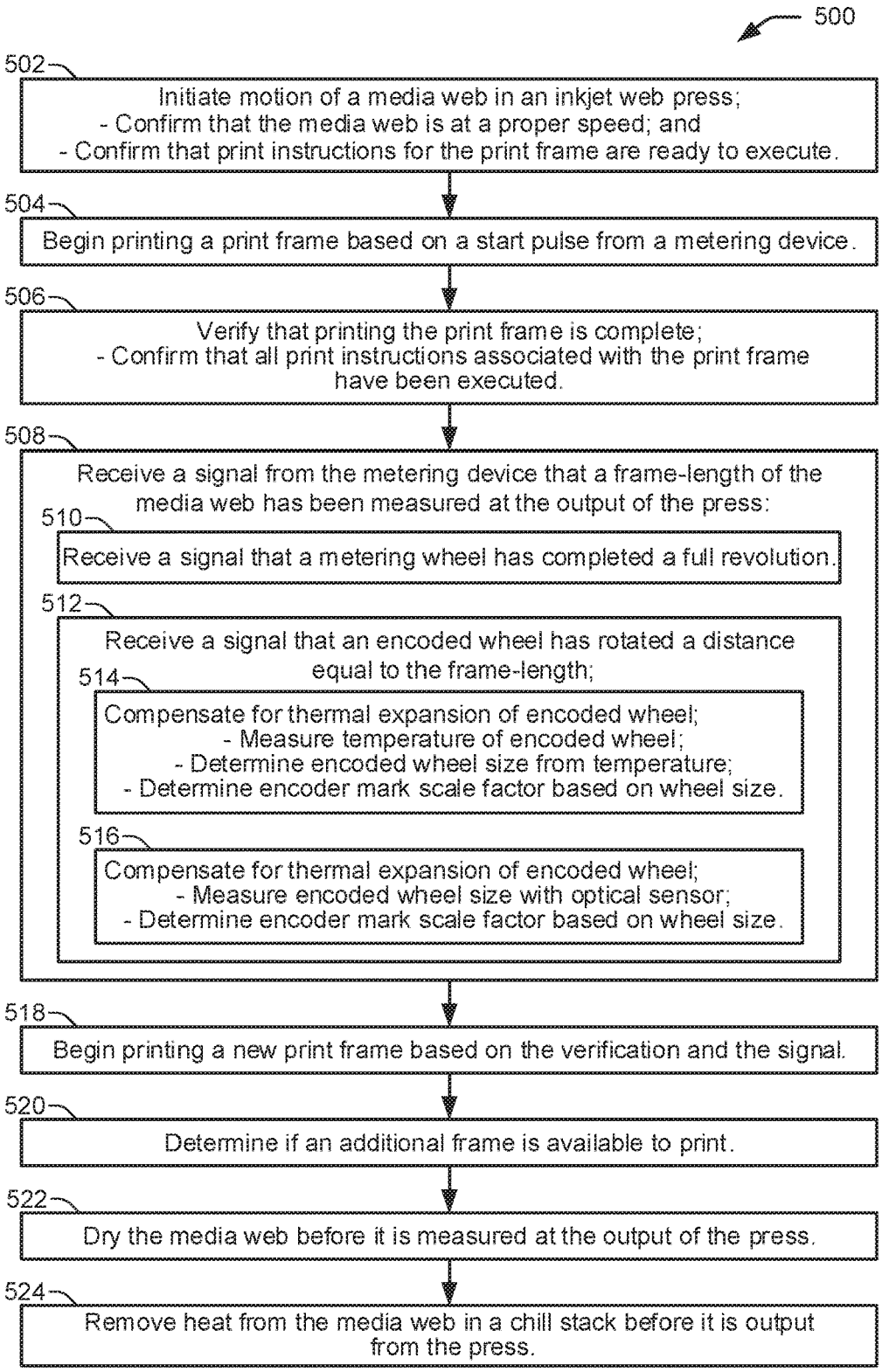
FIGS. 5 and 6 show flowcharts of example methods related to providing fixed frame-length control of print frames on a media web, according to different example implementations.
Figure 6:
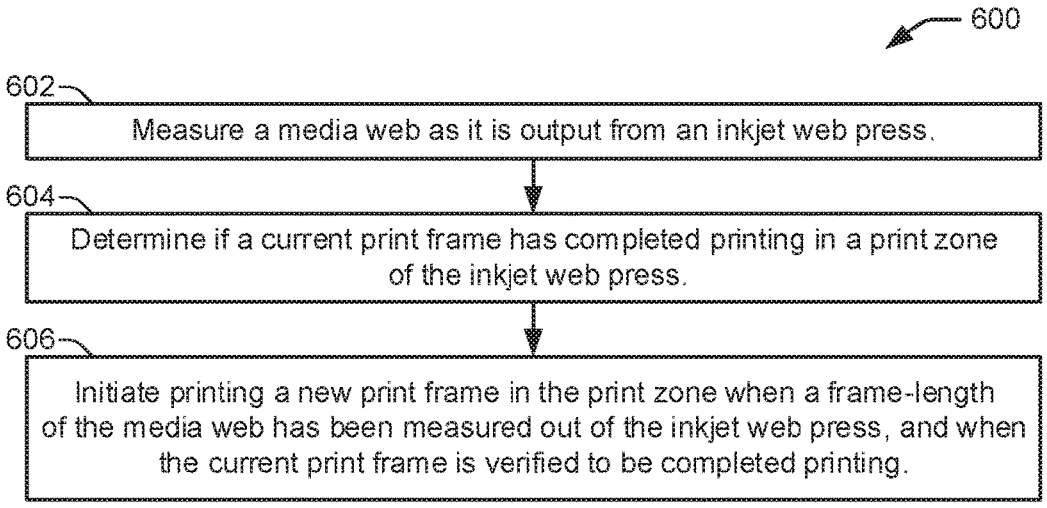

FIGS. 5 and 6 show flowcharts of example methods 500 and 600, related to providing fixed frame-length control of print frames on a media web. Methods 500 and 600, are associated with the example implementations discussed above with regard to FIGS. 1-4, and details of the steps shown in methods 500 and 600, can be found in the related discussion of such implementations. The steps of methods 500 and 600, may be embodied as programming instructions stored on a non-transitory computer/processor-readable medium, such as memory 202 of FIG. 2. In different examples, the implementation of the steps of methods 500 and 600, is achieved by the reading and execution of such programming instructions by a processor, such as processor 200 of FIG. 2. Methods 500 and 600, may include more than one implementation, and different implementations of methods 500 and 600, may not employ every step presented in the flowcharts. Therefore, while steps of methods 500 and 600, are presented in a particular order within the flowcharts, the order of their presentation is not intended to be a limitation as to the order in which the steps may actually be implemented, or as to whether all of the steps may be implemented. For example, one implementation of method 500 might be achieved through the performance of a number of initial steps, without performing one or more subsequent steps, while another implementation of method 500 might be achieved through the performance of all of the steps.

Referring to FIG. 5, method 500 begins at block 502, where the first step shown is to initiate motion of a media web within an inkjet web press. Initiating the media web motion includes confirming that the media web is at a proper speed, and that print instructions for a first/current print frame are loaded and ready to execute. At block 504 of method 500, the first/current print frame can begin printing based on a start pulse received from a metering device. The metering device is at the output of the press, measuring the media web after it has already been printed on and dried. The method 500 continues at block 506 with verifying that the printing of the first/current print frame is completed. Verifying that the print frame has completed printing entails confirming that all print instructions associated with the print frame have been executed. At block 508, the method continues with receiving a signal from the metering device that a fixed frame-length of the media web has been measured at the output of the press. Depending on how the metering device is implemented, receiving the metering device signal can include receiving a signal that a metering wheel has completed a full revolution, as shown at block 510, or it can include receiving a signal that an encoded wheel has rotated a distance equal to the frame-length, as shown at block 512. As shown at block 514, receiving the metering device signal can further include compensating for thermal expansion of the encoded wheel, which can include measuring the temperature of the encoded wheel, determining the encoded wheel size from the temperature (e.g., from a look up table), and determining an encoder mark scale factor based on wheel size (e.g., from a look up table). As shown at block 516, compensating for thermal expansion of the encoded wheel can also include directly measuring the encoded wheel size with an optical sensor (or other sensor such as a proximity sensor), and determining an encoder mark scale factor based on the wheel size.

At block 518, the method 500 begins printing a new print frame based on the verification that the first/current frame has completed printing and based on the signal from the metering device that a fixed frame-length of the media web has been measured at the output of the press. The method 500 then determines if an additional frame is available to print, as shown at block 520. Additional steps of method 500 can include drying the media web before it is measured at the output of the press, as shown at block 522, and removing heat from the media web in a chill stack before the web is output from the press, as shown at block 524. If heat is removed from the media web with a chill stack, steps 514 and 516 that compensate for thermal expansion may be reduced or eliminated.

Referring to FIG. 6, method 600 begins at block 602, where the first step shown is to measure a media web as it is output from an inkjet web press. At block 604 of method 600, it is determine if a current print frame has completed printing in a print zone of the inkjet web press. At block 606, the printing of a new print frame is initiated in the print zone when a fixed frame-length of the media web has been measured out of the inkjet web press, and when the current print frame is verified to be completed printing.

What is claimed is:

1. A printing press comprising:

a metering device to measure dry, printed-upon media output from the printing press;

a controller to start printing a new print frame in response to a plurality of criteria being met, the plurality of criteria comprising:

receiving a signal from the metering device that a frame-length of the dry printed-upon media has been measured; and verifying that a current print frame has completed printing.

2. The printing press of claim 1, wherein the metering device is a device selected from the group consisting of a metering wheel whose circumference has been selected to match the frame-length, and an encoded wheel having encoding marks to measure the frame-length of the media.

3. The printing press of claim 1, further comprising:

a print module to eject fluid drops onto a media web in a print zone;

a dryer to dry the media web after the media web leaves the print zone, resulting in the dry, printed-upon media; and a roller chill stack to remove heat from the dry, printed-upon media prior to measuring by the metering device.

4. The printing press of claim 1, wherein the measured frame-length of the dry printed-upon media comprises a tolerance band.

5. A printing system, comprising:

a metering device to measure printed-upon media output from the printing system;

a controller to initiate printing a new print frame in response to criteria being met, the criteria comprising:

receiving a signal from the metering device that a frame-length of the printed-upon media has been measured; and verifying that a current print frame has completed printing.

6. The printing system of claim 5, wherein the metering device is a metering wheel whose circumference has been selected to match the frame-length.

7. The printing system of claim 5, wherein the metering device is an encoded wheel having encoding marks to measure the frame-length of the media.

8. The printing system of claim 7, further comprising a temperature sensor to measure the temperature of the encoded wheel.

9. The printing system of claim 8, wherein the controller compensates for a change in a circumference of the encoded wheel by referencing to a look-up table to determine an encoder wheel size correlated to the measured temperature.

10. The printing system of claim 9, wherein the encoder wheel size is used, via the look up table, to determine an encoder scaling factor used to adjust for change in distance between encoder marks on the encoder wheel.

11. The printing system of claim 9, the printing system further comprising an optical sensor comprising a bank of light emitters and corresponding light receivers to determine the size of the encoder wheel.

12. A method for providing a fixed frame-length control of print frames, comprising:

with a controller of a printing system:

initiating motion of a media web in the printing system;

printing first print frame based on a start pulse from a metering device;

verifying that a printing process of the print frame is completed;

receiving a signal, at the controller, from the metering device that a frame-length of the media web has been measured at an output of the printing system; and initiating printing of a second print frame based on the verification and the signal.

13. The method of claim 12, wherein initiating motion of the media web comprises:

confirming that the media web is at a proper speed; and confirming that print instructions for the print frame are ready to execute.

14. The method of claim 13, wherein the instructions, when executed by the controller, cause the printing system to determine if a third frame is available to print.

15. The method of claim 12, wherein the metering device is an encoder wheel and wherein receiving the signal from the metering device comprises receiving a signal that the encoder wheel has rotated a distance equal to the frame-length.

16. The printing system of claim 5, the controller further to determine if an additional frame is available to print prior to initiating printing of a new print frame.

17. The printing system of claim 5, the controller further to confirm that the media is moving at a target speed prior to initiating printing of the new print frame.

18. The printing system of claim 5, wherein the signal from the metering device that a frame-length of the printed-upon media has been measured comprises an indication that an encoded wheel rotating with motion of the media has completed a full revolution.

19. A printing system, comprising:

an encoded wheel having encoding marks to measure a frame-length along printed-upon media output from the printing system;

a temperature sensor to measure the temperature of the encoded wheel; and a controller to:

compensate for a change in a circumference of the encoded wheel by referencing to a look-up table to determine an encoder wheel size correlated to the measured temperature; and initiate printing a new print frame in response to criteria being met, the criteria comprising:

receiving a signal based on operation of the encoded wheel that a frame-length of the printed-upon media has been measured; and verifying that a current print frame has completed printing.

20. The printing system of claim 19, wherein the circumference of the encoded wheel is matched to the frame-length of printing on the media.

* * * * *